US005352087A

United States Patent [19]

Antonellis

[11] Patent Number: 5,352,087

[45] Date of Patent: Oct. 4, 1994

[54] COOLING FLUID EJECTOR

[75] Inventor: Stephen M. Antonellis, Woodbury, Conn.

[73] Assignee: United Technologies Corporation, Hartford, Conn.

[21] Appl. No.: 81,902

[22] Filed: Jun. 23, 1993

[51] Int. Cl.[5] ..... F04D 29/38

[52] U.S. Cl. ..... 415/115; 415/173.7; 415/116

[58] Field of Search ..... 415/115, 116, 173.7, 415/173.5, 174.5, 110, 111, 112; 277/53, 56, 57

[56] References Cited

U.S. PATENT DOCUMENTS

| | | | |
|---|---|---|---|
| 3,135,215 | 6/1964 | Smith | 415/111 |
| 4,265,590 | 5/1981 | Davies | 415/110 |
| 4,553,901 | 11/1985 | Laurello | 415/173.7 |
| 4,627,233 | 12/1986 | Baran, Jr. | 415/115 |
| 4,645,424 | 2/1987 | Peters | 415/173.7 |
| 4,659,289 | 4/1987 | Kalogeros | 415/173.7 |
| 4,752,185 | 6/1988 | Butler et al. | 415/116 |
| 4,869,640 | 9/1989 | Schwarz et al. | 415/115 |

*Primary Examiner*—Edward K. Look
*Assistant Examiner*—Mark Sgantzos

[57] ABSTRACT

A turbine section having a seal cavity with effectively continuous flow surfaces is disclosed. Various construction details are developed which disclose a fluid cooled stator assembly having a plurality of ejectors for flowing cooling fluid into the seal cavity. In one embodiment, the ejectors (114) include a wall (132) which have circumferentially spaced mating edges (134, 136) arranged in a cascade type configuration. The arrangement of the walls provides an effectively continuous flow surface for the radially flowing annulus of cooling fluid within a seal cavity (108). In an alternate embodiment, an opening (152) between adjacent mating edges (154, 156) provides access to mechanical fasteners (162) which retain a sealing shroud (164) to a stator assembly (150).

24 Claims, 4 Drawing Sheets

COOLING FLUID EJECTOR

This is a request for filling a continuation application under 37 CFR 1.62 of prior pending application Ser. No. 07/833,256 filed on Feb. 10, 1992.

TECHNICAL FIELD

This invention relates to gas turbine engines and, more particularly, to turbine stator assemblies.

BACKGROUND ART

A typical gas turbine engine has a compressor section, a combustion section and a turbine section. The gas turbine engine includes an annular flowpath for conducting working fluid sequentially through the compressor, combustor, and turbine sections. The compressor has an array of rotating blades and non-rotating stator vanes. The rotating blades compress the working fluid and thereby add momentum to the working fluid. The non-rotating stator vanes orient the flow of working fluid for optimum transfer of energy. Fuel is then added to the compressed working fluid in the combustion section. The mixture of fuel and working fluid is burned in a combustion process which adds energy to the working fluid. The hot working fluid is then expanded through the turbine section. The turbine section includes another array of rotating blades and non-rotating stator vanes. The interaction of the working fluid and the turbine blades transfers energy to the turbine blades. The turbine blades are connected to a rotating shaft which is connected to the compressor blades. In this way the energy which is transferred from the working fluid to the turbine blades is used to compress incoming working fluid in the compressor.

The combustion process raises the temperature of the working fluid in direct proportion to the energy added. The temperature of the working fluid, and thereby the amount of energy which can be added, is limited by the temperature characteristics of the materials used in the turbine section. During operation, rotational forces introduce significant stresses on rotating structure within the turbine section. Increases in temperature reduce the allowable stress and degrade the structural integrity of turbine materials. Therefore, structure within the turbine section must be maintained within acceptable temperature levels. This is especially critical for the first stages of the turbine section which encounter working fluid having the highest temperature.

Structure of particular importance in the turbine section is the rotating seals between the inner diameter of the stator vane assembly and a seal runner extending axially between rotor assemblies. Rotating seals minimize the amount of working fluid which bypasses the blades and vanes, and thereby maximizes the interaction between the working fluid and the airfoil portions of the blades and vanes. A typical rotating seal includes a plurality of radially extending knife-edges disposed on the seal runner which engage an annular shroud of abradable material disposed on the radially inner end of the stator vanes. Gaps exist between the knife-edges and shroud. The size of the gaps must be minimized to maintain proper operation of the rotating seals. Varying operating conditions will produce varying amounts of thermal expansion and thereby variable gap sizes. Therefore, control of the temperature adjacent to the rotating seals is necessary to maintain the gap within acceptable limits.

As is well known in the prior art, a method of maintaining the first stages of the turbine section within acceptable temperature levels is to install a cooling system in the turbine stator vanes. One such cooling system comprises means to inject or conduct cooling air into the body of the hollow stator vanes. Typically compressor bleed air is used as a source of cooling air. In this way cooling is provided to the portion of the stator vanes which extends through the flowpath. The cooling fluid is exhausted through the radially inner portion of the stator vane. A seal cavity, disposed radially inward of the stator vanes, receives the flow of cooling air from the stator vanes. The cooling fluid then cools the rotating seals and other structure local to the seal cavity. Rotating flow surfaces produce a circumferentially flowing, annular body of fluid within the cavity. A drawback to all such cooling systems is the reduced efficiency of the turbine engine as a result of the diversion of working fluid from the compressor section.

Cooling systems for stator vanes and seal cavities have been the focus of much gas turbine research and development. A major focus has been on using the cooling fluid within the seal cavity as efficiently as possible, thereby minimizing the amount of cooling fluid required. Minimizing the cooling fluid taken from the compressor section increases the efficiency of the gas turbine engine.

One example is U.S. Pat. No. 4,869,640, issued to Schwarz et al, entitled "Controlled Temperature Rotating Seal". Schwarz et al discloses structure having a plurality of axially extending, overlapping baffles which cooperate to define multiple mixing volumes within the seal cavity. An intermediate volume is disposed between the working fluid and an innermost volume and provides a thermal buffer between the two. The innermost cavity is partially bounded by and provides cooling fluid for the rotating seals. The thermal buffer prevents direct access of the hot working fluid into the innermost volume. In this way the innermost volume and the rotating seals are maintained at a lower temperature than the intermediate volume.

Aerodynamics of the seal cavity is also a concern as local structure may cause windage losses. Windage losses are the result of the interaction between circumferentially non-continuous flow surfaces and the radially rotating annulus of fluid within the seal cavity. Windage losses generate heat and result in a loss of efficiency for the cooling system and the gas turbine engine. U.S. Pat. No. 4,846,628, issued to Antonellis and entitled "Rotor Assembly for a Turbomachine", is an example of structure which reduces windage losses within the seal cavity. Antonellis discloses a sideplate which is releasably secured to a rotor assembly and has a smooth annular flow surface. The smooth annular flow surface reduces discontinuities within the seal cavity and results in reduced windage losses.

The above art notwithstanding, scientists and engineers under the direction of Applicants' Assignee are working to develop efficient cooling systems for the first stages of the turbine section of a gas turbine engine.

DISCLOSURE OF INVENTION

An object of the invention is efficient cooling of seal cavity of a gas turbine engine.

Another object of the invention is a seal cavity with reduced windage losses.

According to the present invention, a stator vane assembly for a gas turbine engine includes a plurality of cooling fluid ejectors having wall means adapted to permit ejection of cooling fluid into a seal cavity and to provide a smooth annular flow surface within the seal cavity.

According to a specific embodiment of the invention, the wall means includes a plurality of wall portions having circumferential edges which mate in a cascade arrangement to provide an effectively continuous flow surface in circumferential flow direction. A flow surface which is effectively continuous in the circumferential flow direction is defined as a flow surface which discourages non-circumferential flow of the circumferentially flowing annular body of fluid within the seal cavity.

According further to the present invention, the ejector includes an internal duct and an aperture through which cooling fluid is ejected into the seal cavity with a velocity having magnitude and direction which is comparable to the velocity of the fluid within the seal cavity. The magnitude is produced by sizing the duct and aperture to eject the cooling air at or near the magnitude of velocity of the fluid within the cavity flowing past the aperture. The direction is approximated by angling a portion of the duct adjacent to the aperture to be as closely tangential as possible with the direction of flow within the seal cavity.

According to an alternative embodiment of the present invention, an opening between pairs of mating edges is adapted to permit access to a sealing shroud fastening means while providing an effectively continuous flow surface in the vicinity of the mating edges.

A principal feature of the present invention is the effectively continuous flow surface formed by the cascade arrangement of the mating edges of the plurality of wall portions. Another feature is rounded corners on the downstream mating edges. A further feature is the angled duct internal to the ejector.

An advantage of the present invention is the level of efficiency of the gas turbine engine as a result of the reduced windage losses within the seal cavity. Windage losses are kept to a minimum because of the circumferentially continuous and smooth flow surfaces within the seal cavity. The ejector walls isolate the ejector and other stator assembly structure from the seal cavity to create a pedestal volume defined by non-rotating structure. The cascade arrangement of the mating edges provides a step down in the flow within the cavity which effectively eliminates the separation between the mating edges as discrete objects. In addition, each downstream edge is rounded to discourage the fluid within the seal cavity from flowing axially between the mating edges.

A further advantage of the present invention is the improved efficiency of the gas turbine engine as a result of the tangential ejection of the cooling fluid into the seal cavity. Prior to ejection, the angled duct internal to each ejector turns the flow of cooling fluid so that it is flowing in a direction tangential to the circumferentially flowing annular body of fluid within the seal cavity. In addition, the length to effective diameter ratio of the duct and aperture ensure that the cooling fluid is ejected at a velocity comparable to that of the body of fluid within the seal cavity as it flows past the aperture. This feature reduces the amount of work the local rotating structure must do in order to bring the ejected fluid up to the speed of the rotating structure.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
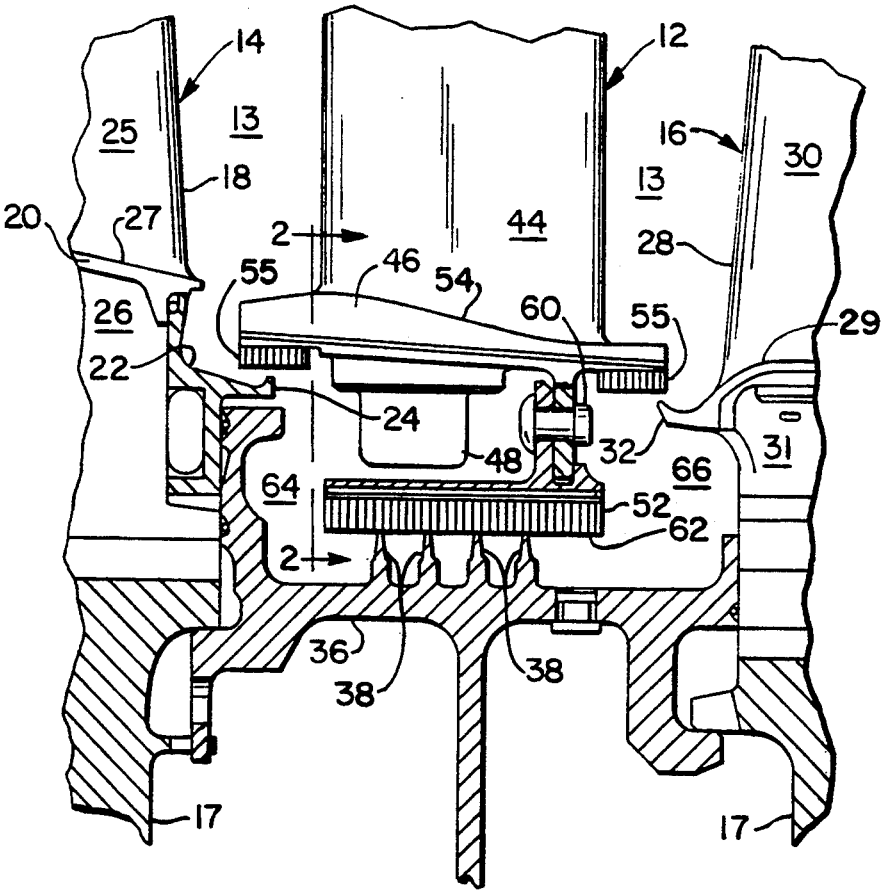
FIG. 1 PRIOR ART
FIG. 1 is a side view of a stator vane assembly, disposed between a first turbine rotor assembly and a second turbine rotor assembly, in accordance with the prior art.
Figure 2:
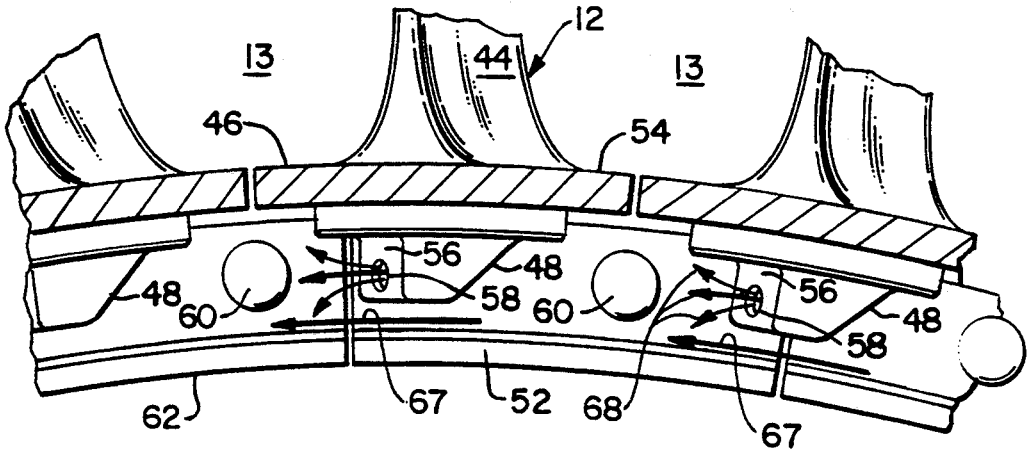
FIG. 2 PRIOR ART
FIG. 2 is view taken along line 2—2 of FIG. 1 of a stator vane assembly in accordance with the prior art.
Figure 3:
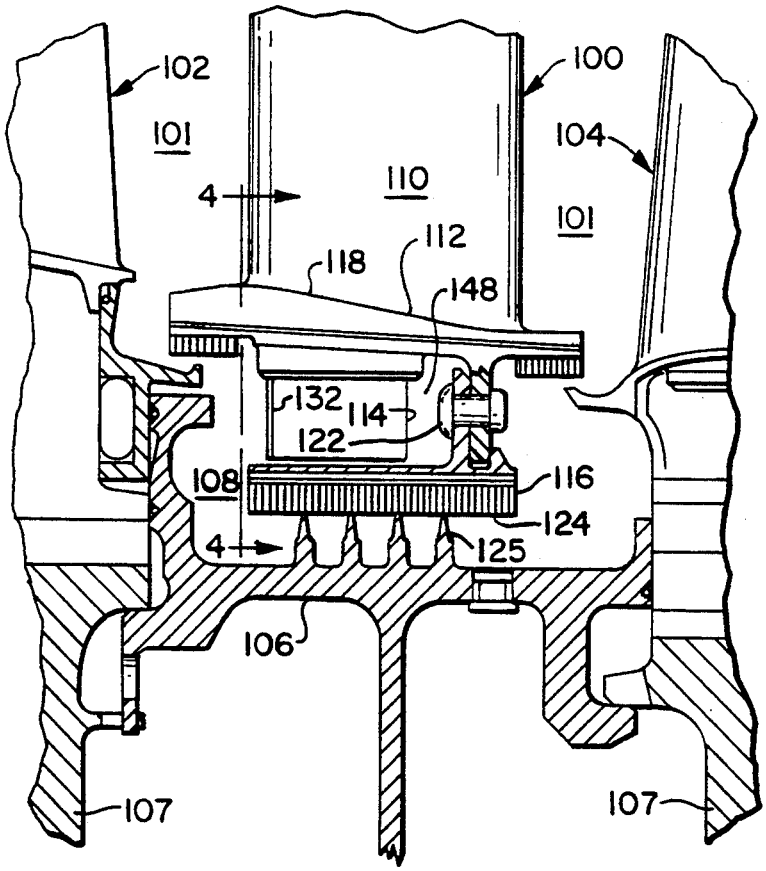
FIG. 3 is a side view of a stator vane assembly, disposed between a first turbine rotor assembly and a second turbine rotor assembly, in accordance with the present invention.

Illustrated in FIGS. 1 and 2 is a prior art stator vane assembly 12 within a turbine section of a gas turbine engine. The stator vane assembly 12 extends circumferentially about the longitudinal axis of the gas turbine engine and through a working fluid flow passage 13. The stator vane assembly is positioned axially downstream of a first stage turbine rotor assembly 14 and axially upstream of a second stage turbine rotor assembly 16. The rotor assemblies 14, 16 extend circumferentially about an axially disposed rotating disk 17 and extend radially through a working fluid flow passage 13.

The first stage turbine rotor assembly 14 includes a plurality of blades 18, a corresponding plurality of platforms 20, and a side plate 22 having a knife-edge seal 24. Each blade includes an airfoil portion 25 which extends into the working fluid flow passage 13 and a root portion 26 attached to the disk 17. The platform 20 provides a radially inner flow surface 27 for the working fluid flow passage 13. The knife-edge seal 24 extends radially outward from the sideplate 22 and engages the stator vane assembly 12. The knife-edge seal provides sealing means between the first stage rotor assembly 14 and the stator vane assembly 12 to block working fluid from flowing radially inward.

The second stage turbine rotor assembly 16 includes a plurality of blades 28 and platforms 29. Each blade includes an airfoil portion 30 which extends into the working fluid flow passage 13 and a root portion 31 attached to the disk 17. Each platform 29 has a knife-edge seal 32 disposed on the upstream end of the platform 29. The knife-edge seal extends radially outward and engages the stator vane assembly 12 to provide sealing means between the stator vane assembly 12 and the second stage turbine rotor assembly 16 to block working fluid from flowing radially inward.

A seal runner 36 is disposed on the rotatable disk 17 and extends axially between the first stage rotor assembly 14 and the second stage turbine rotor assembly 16. The seal runner 36 is an annular structure and includes a plurality of knife-edge seals 38 extending radially outward. The knife-edge seals 38 engage the stator vane assembly 12 to provide sealing means between the first stage turbine rotor assembly 14 and the second stage turbine rotor assembly 16.

The stator vane assembly 12 includes a vane 44, a platform 46, an ejector 48, and a sealing shroud 52. The aerodynamically shaped vane 44 extends across the working fluid flow passage 13 and is attached to a radially outer casing (not shown) of the turbine engine. The vane 44 is hollow to allow passage of cooling fluid radially through the vane 44. An opening between the vane 44 and the ejector 48 permits communication between the hollowed vane and the ejectors and passage of the cooling fluid into the ejector 48.

The platform 46 provides a radially inner surface 54 for the working fluid flow passage 13 and abradable surfaces 55 adapted to engage knife-edge seals 24, 32 to provide sealing means. The sealing means provided by the surfaces 55 and the knife-edge seals 24, 32 blocks the working fluid from flowing radially inwardly and out of the flowpath 13.

The ejector 48 is a cubic structure which is in communication with the hollow region of the vane 44. The ejector 48 includes a cavity wall 56 having an aperture 58. The aperture 58 provides means for passing the cooling flow out of the ejector 48.

The sealing shroud 52 is fastened to the stator vane assembly 12 by a mechanical fastener 60. The sealing shroud 52 provides a radially inner surface 62 which engages the knife-edge seals 38 of the seal runner 36. The radially inner surface 62 is an abradable surface which, in conjunction with the knife-edge seals 38, provides sealing means to block the axial flow of gases between the seal runner 36 and the stator vane assembly 12.

An upstream seal cavity 64 is defined by the separation between the first stage turbine rotor assembly 14, the stator vane assembly 12, and the seal runner 36. Knife-edge seal 24 and surface 55 block working fluid from entering the cavity. Knife-edge seals 38 and surface 62 block fluid within the seal cavity 64 from flowing axially downstream.

A downstream seal cavity 66 is defined by the separation between the stator vane assembly 12, the second stage turbine rotor assembly 16, and the downstream end of the seal runner 36. The seal cavity 66 is sealed by the engagement of surfaces 55 and 62 with knife-edge seals 32 and 38, respectively. No cooling fluid is exhausted from the ejectors 48 into the downstream seal cavity 66.

During operation, friction from the rotating flow surfaces of the first stage turbine rotor assembly 14 and the seal runner 36 causes the body of fluid within the upstream seal cavity 64 to rotate about the longitudinal axis. The seal cavity 64 becomes a circumferentially flowing annular body of fluid as shown by arrows 67. The fluid within the seal cavity is comprised of a mixture of cooling fluid from the ejector 48 and working fluid which leaks around the knife-edge seal 24. The cooling fluid from the ejectors 48 must be sufficient to counter-balance the hot working fluid leaking around seal 24 and provide adequate cooling within the seal cavity 64. Cooling is necessary to maintain the structural integrity of high stressed, rotating structure and to maintain proper operation of the sealing means. Diverting compressed air from the compressor section, or providing an external source of cooling air, to provide cooling in the turbine section reduces overall engine efficiency.

The plurality of ejectors 48 and the plurality of mechanical fasteners 60 introduce discrete obstructions in the circumferentially flowing annular body of fluid within the seal cavity 64. These obstructions produce windage losses which in turn heat up the fluid flowing in the seal cavity 64. In addition, the cooling fluid ejected from the ejector 48, because of the small length to diameter ratio of the aperture 58, is diffusely disbursed into the seal cavity 64, as shown by arrows 68, and has a low velocity relative to the annular flow. The diffuse spreading and low velocity cause friction of the cooling fluid entering the seal cavity 64 with the rotating surfaces of the seal runner 36 and first stage turbine rotor assembly 14. This friction, while bringing the cooling fluid up to the speed of the annular flow within the seal cavity 64, also raises the temperature of the fluid within the seal cavity 64. The adverse affects of windage losses and diffuse disbursement of cooling fluid must be counter-balanced by a quantity of cooling fluid. Diverting additional compressed air from the compressor section, or providing an additional external source of cooling air, to counterbalance losses in the seal cavity reduces overall engine efficiency even further.

Illustrated in FIGS. 3–6 is a turbine section 99 having a stator vane assembly 100 in accordance with the present invention. The stator vane assembly 100 extends circumferentially about the longitudinal axis of the gas turbine engine and through a working fluid flow passage 101. The stator vane assembly 100 is axially disposed between a first stage turbine rotor assembly 102 and a second stage turbine rotor assembly 104, both of which are identical to the rotor assemblies 14,16 disclosed in the prior art (see FIGS. 1 and 2). In addition, a seal runner 106, identical to the seal runner 36 of the prior art, extends axially between the first stage turbine rotor assembly 102 and the second stage turbine rotor assembly 104. The rotor assemblies 102, 104, and seal runner 106 extend circumferentially about an axially disposed rotatable disk 107. The vane assembly 100 and rotor assemblies 102, 104 extend radially through the working fluid flow passage 101. An upstream seal cavity 108 is defined by the separation between the first stage turbine rotor assembly 102, the stator vane assembly 100, and the seal runner 106.

The stator vane assembly 100 includes a vane 110, a platform 112, an ejector 114, and a sealing shroud 116. As in the prior art, the vane 110 is hollow and aerodynamically shaped and extends across the working fluid flow passage 101. The vane 110 is disposed on a radially outer casing (not shown) and is in communication with cooling fluid flowing through the turbine section 99. The platform 112 provides a radially inner flow surface 118 for the working fluid flow passage. The sealing shroud 116 is fastened to the platform 112 by a mechanical fastener 122. The sealing shroud 116 provides an abradable, radially inner sealing surface 124 which is engaged with a plurality of knife-edge seals 125 on the seal runner 106.

Figure 4:
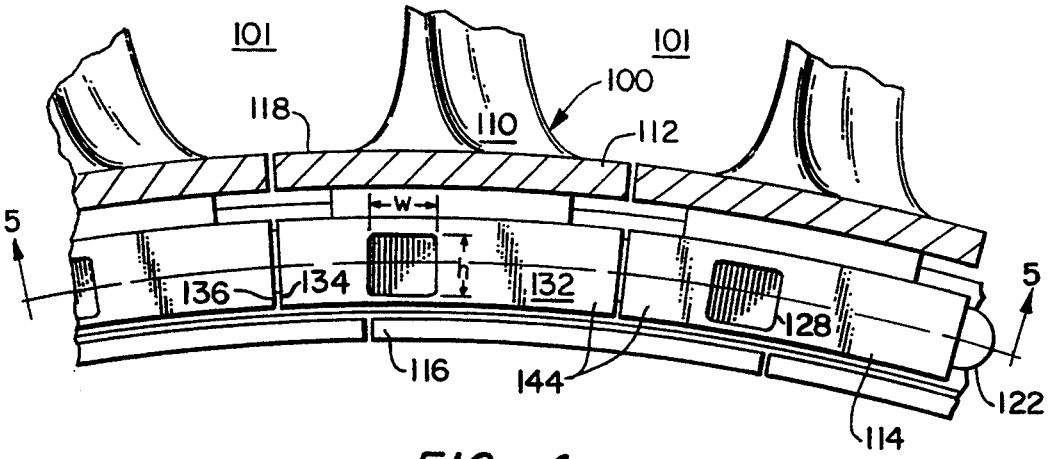
FIG. 4 is a view taken along line 4—4 of FIG. 3.
Figure 5:
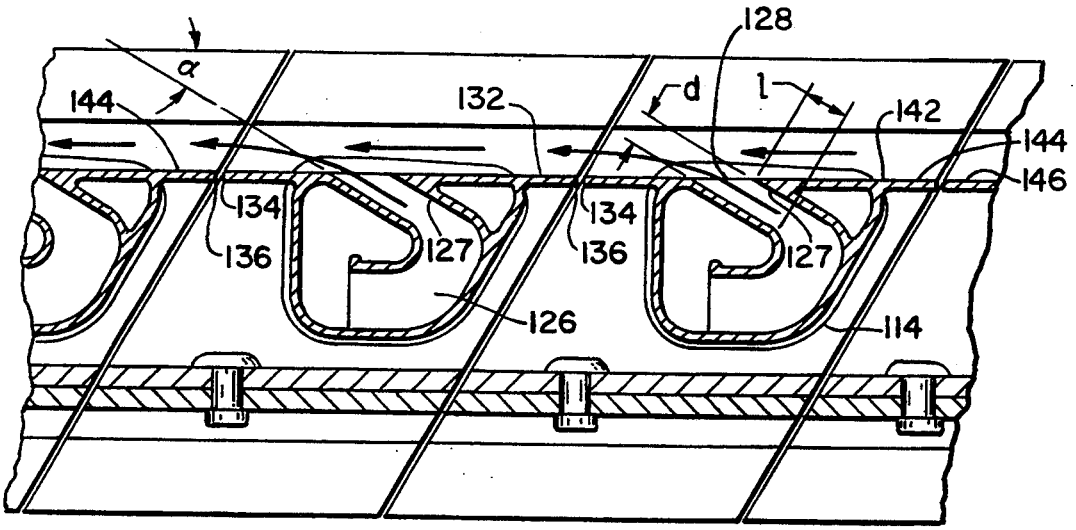
FIG. 5 is a cross-sectional view of a stator vane assembly taken along line 5—5 of FIG. 4.

The ejector 114 is in communication with the hollow portion of the vane 110 and is a box-like structure. The ejector 114 includes an internal flow channel 126, a rectangular aperture 128, and a circumferentially extending wall 132. The flow channel 126 has a linear portion 127 with a length parameter 1. The straight portion 127 provides directionality to the cooling fluid exiting the ejector 114 by extending the length parameter 1 relative to the of the aperture 128. Since the aperture 128 is rectangular in shape, a useful measure of its size is effective diameter or hydraulic diameter. As is well know, hydraulic diameter $d_h$ is defined as:

$$d_h = \frac{4 \cdot A}{P} = \frac{4(h \times w)}{(2h + 2w)}$$

where A is the area of the aperture, P is the perimeter, h is the aperture height and w is the aperture width (see (FIG. 4). The cooling fluid is ejected at an angle $\alpha$ relative to the direction of flow within the seal cavity 108. The angle $\alpha$ is as small as possible such that the cooling fluid is ejected into the seal cavity 108 substantially tangential to the circumferentially flowing annular body of fluid within the seal cavity 108. Although it may be desirable to have the angle $\alpha$ as small as possible, in practice angle $\alpha$ may be limited by space constraints, such as the length 1 required for directing the cooling flow and the aperture size required for ejection of adequate cooling fluid into the seal cavity 108. Substantially tangential is defined as an angle $\alpha$ of less than or equal to 45°.

The magnitude of the velocity of the cooling fluid exiting the ejector 114 is dependent on the pressure difference between the ejector 114 and the seal cavity 108 and on the cross-sectional area of the linear portion 127 and aperture 128. The pressure difference is dependent upon operational conditions of the turbine engine. The size of the linear portion 127 and aperture 128 are such that, for a given pressure differential, the magnitude of the flow velocity of the cooling fluid exiting the ejector is comparable to the magnitude of the flow velocity of the fluid within the cavity flowing past the ejector. A magnitude of the flow velocity of the cooling fluid greater then one-tenth (1/10) of the magnitude of the flow velocity of the fluid within the cavity is suggested by Applicants as being comparable.

The aperture 128 is rectangular in order to increase the size of the aperture 128. The area of the aperture 128 limits the volumetric flow rate of coolant flow entering the seal cavity 108. With the space constraints present within the seal cavity 108, a rectangular aperture maximizes the effective diameter $d_h$ of the aperture. It should be understood, however, that apertures having non-rectangular shapes may provide sufficient cooling flow.

The wall 132 extends beyond the circumferential dimensions of the ejector 114 and has a circumferential mating edge 134 which are in close proximity to a circumferential mating edge 136 of an adjacent wall. The wall 132 extends radially between the sealing shroud 116 and the platform 112. Each wall 132 has a flow surface 142 which faces the seal cavity 108. The plurality of walls 144 provide a wall means defining a flow surface 146 for the seal cavity 108 which is effectively continuous in the circumferential direction.

Figure 6:
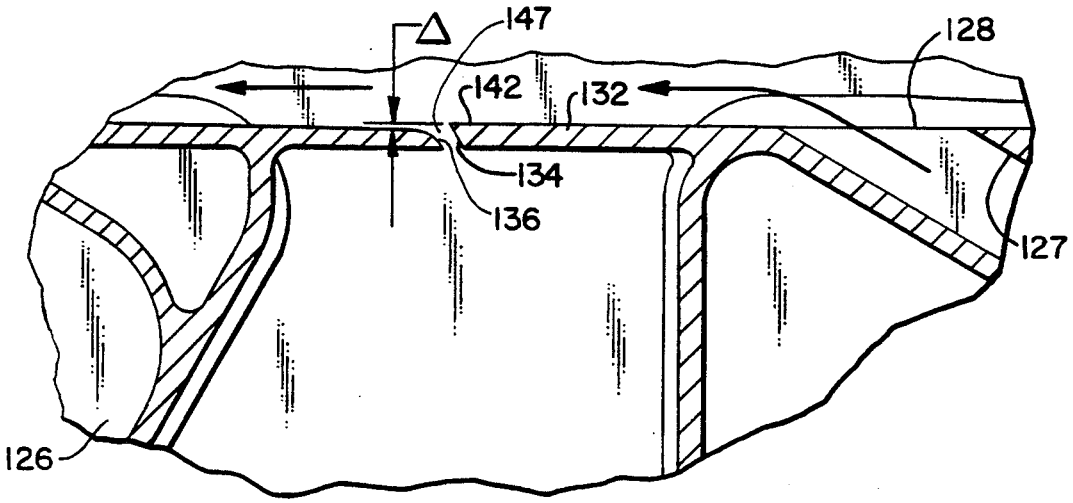
FIG. 6 is a view of a pair of mating edges of adjacent ejector walls.

As shown in FIG. 6, circumferential mating edges 134, 136 are configured in a waterfall or cascade type arrangement relative to the circumferentially flowing annular body of fluid within the seal cavity 108. The cascade arrangement provides an axial offset or step down in the flow path of the amount shown by $\Delta$. The step down urges the fluid within the cavity to continue to flow circumferentially. By doing so, the cascade arrangement discourages the fluid from flowing through separations 147 between the walls 132. It is suggested that the size of the axial offset or step $\Delta$ be less than or equal to the thickness of the walls 132.

The upstream mating edge 134 is a trailing edge relative to the flow within the seal cavity 108. The downstream mating edge 136 is a leading edge relative to the flow within the seal cavity 108. The corner of the mating edge 136 nearest the seal cavity 108 is rounded. Rounding the corner also urges the flow to continue in a circumferential direction and discourages axially directed flow through the separation 147.

In addition, the apertures 128 do not appear as structural obstructions to the circumferentially flowing annular body of fluid within the seal cavity 108. Because of the higher pressure of the cooling fluid exiting the ejector 114, relative to the pressure within the seal cavity, and the tangential ejection, the cooling fluid provides minimal interference with the circumferential aspect of the flow within the seal cavity 108.

During operation, the wall 132 removes the ejector 114 and mechanical fastener 122 from the flow within the seal cavity 108 and defines a pedestal volume 148 radially inward of the vane 110. Removing the ejector 114 and mechanical fastener 122 from the flow within the seal cavity 108 removes these obstructions and reduces the interferences which cause windage losses. The pedestal volume 148 contains fluid which is relatively static, as compared to the annular flow within the seal cavity 108. The fluid within the pedestal cavity 148 provides limited cooling to the stator vane assembly 100. The stator vane assembly, however, is nonrotating structure and therefore requires less cooling than other highly stressed, rotating structure.

The coolant flow entering the seal cavity 108, which has significant velocity substantially tangential to the flow in the seal cavity 108, reduces the amount of friction between the rotating surfaces and the cooling flow entering the seal cavity 108. The friction is the result of the rotating flow surfaces having a higher velocity than the fluid adjacent to them. Lowering the friction lowers the amount of heat generated by the friction.

In addition, the wall 132 also reduces the axial width of the seal cavity. Reducing the axial width of the seal cavity 108 reduces the likelihood of transverse recirculation within the seal cavity 108. Transverse recirculation is non-circumferential flow within a plane extending radially and axially through the longitudinal axis. This type of non-circumferential flow disrupts the circumferential flow within the seal cavity 108 and may create eddies which cause losses and reduce the effectiveness of the cooling fluid.

Figure 7:
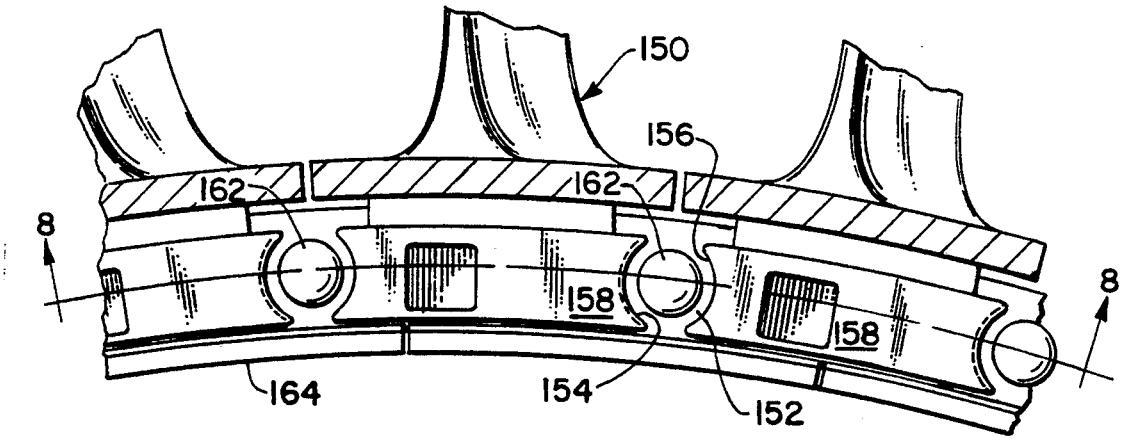
FIG. 7 is a view of a stator vane assembly in accordance with an alternate embodiment.
Figure 8:
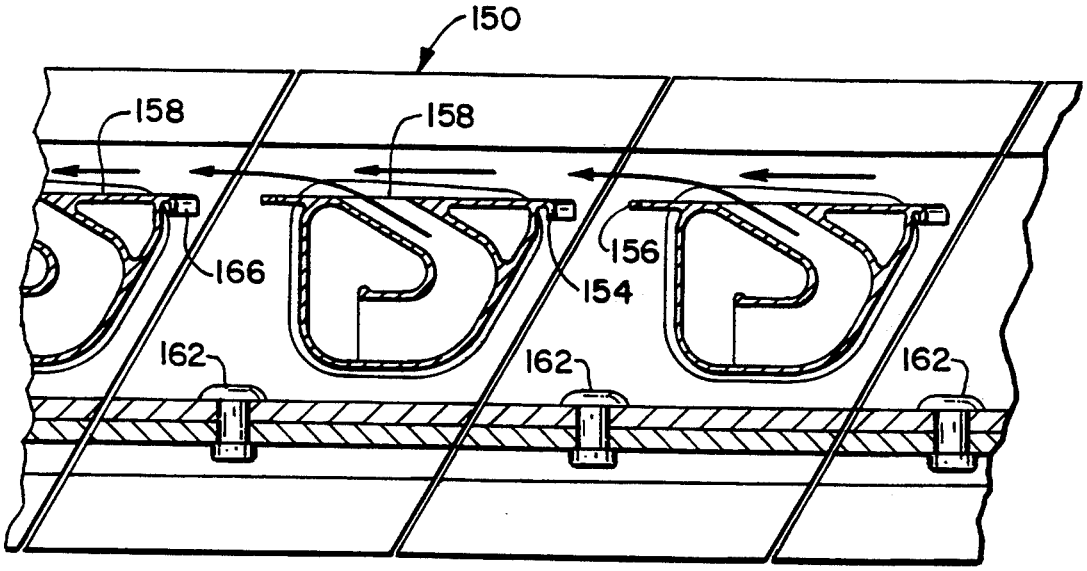
FIG. 8 is a cross-sectional view of a stator vane assembly in accordance with an alternate embodiment taken along line 8—8 of FIG. 7.

Referring now to FIGS. 7 and 8, an alternative embodiment of the present invention is illustrated. A stator assembly 150 has an opening 152 between mating edges 154, 156 of adjacent walls 158. The openings 152 provide access to mechanical fasteners 162 which retain a sealing shroud 164 to the stator assembly 150. As with the embodiment illustrated in FIGS. 3–6, the plurality of mating edges 154, 156 are configured in a cascade type arrangement. In addition, the downstream mating edge 154 is a leading edge relative to the circumferential flow and has a rounded lip 166. The rounded lip 166 and cascade type arrangement reduce the interference with the annular flow caused by the opening 152. In all other aspects, the alternate embodiment is identical to the embodiment shown in FIGS. 3–6.

It should be noted that the plurality of walls define a wall means. The wall means is adapted to provide an effectively continuous, circumferential flow surface for the seal cavity and to isolate the ejector and other discrete, non-rotating objects from the annular body of circumferentially flowing fluid within the seal cavity. The wall means may be comprised of a plurality of walls as shown in FIGS. 3–8, a plurality of arcuate wall segments in which each wall segment includes one or more apertures in communication with a corresponding number of ejectors, or a single annular plate having a plurality of apertures in communication with a plurality of ejectors.

Although this invention has been shown and described with respect to detailed embodiments thereof, it will be understood by those skilled in the art that various changes in form and detail thereof may be made without departing from the spirit and scope of the claimed invention.

I claim:

1. An improved stator vane assembly for a gas turbine engine of the type disposed about a longitudinal axis, having an axially extending flowpath circumferentially disposed about the axis, a turbine section including a first rotor assembly disposed circumferentially about the axis, a second rotor assembly disposed circumferentially about the axis and axially downstream of the first rotor assembly, a seal runner disposed circumferentially about the axis and extending axially between the first rotor assembly and the second rotor assembly, the seal runner including sealing means, and wherein the first rotor assembly, second rotor assembly, and seal runner are rotatable about the axis in an operational condition, and wherein the improvement is comprised of:

the stator vane assembly being disposed axially between the first rotor assembly and the second rotor assembly and radially outward of the seal runner, wherein an annular upstream seal cavity is defined in part by said stator vane assembly, said upstream seal cavity having effectively continuous flow surfaces in the circumferential direction, wherein a downstream seal cavity is defined in part by said stator vane assembly, and wherein said stator vane assembly includes plurality of vanes, each of the vanes being hollow to permit cooling fluid to pass through said vane, a sealing shroud mounted radially inward of said vanes, said sealing shroud engaging said seal runner to block gaseous communication between the upstream seal cavity and the downstream cavity, and a plurality of ejectors, each of said ejectors disposed radially inward of and being in communication with one of said plurality of hollow vanes, each ejector including an aperture permitting cooling fluid to flow into the seal cavity, and the plurality of ejectors defining wall means providing an effectively continuous, circumferential flow surface for the upstream seal cavity and to isolate said ejectors from said seal cavity, wherein said wall means is comprised of a plurality of wall portions, each of said wall portions disposed on an ejector and having a leading edge and a trailing edge, said leading edge and said trailing edge disposed on circumferentially opposite ends of said wall portion, and wherein said trailing edge has a flow surface disposed a finite distance $\Delta$ axially upstream, relative to the direction of flow within the flow path, of a corresponding flow surface of a leading edge of a circumferentially adjacent wall portion.

2. The stator vane assembly according to claim 1 wherein said ejector includes an internal duct directing the cooling fluid with a velocity, the magnitude of the velocity imparted to the cooling fluid being greater than one-tenth (1/10) of the magnitude of the velocity of the circumferentially flowing annular body of fluid within the upstream seal cavity in the operational condition, and the direction of the velocity imparted being substantially tangential to the direction of the circumferentially flowing annular body of fluid within the upstream seal cavity in the operational condition.

3. The stator vane assembly according to claim 2, wherein the internal duct includes a straight portion having a length l, the straight portion directing the cooling fluid to flow in the tangential direction, wherein the aperture has an effective diameter $d_h$, and wherein the length l is greater than the effective diameter $d_h$ of the aperture.

4. The stator vane assembly according to claim 1, wherein said leading edge is rounded to thereby urge cooling fluid within said upstream sealing cavity to flow circumferentially and to block an axial flow of fluid between said leading edge and said trailing edge.

5. The stator vane assembly according to claim 1, further including a mechanical fastener engaged with the sealing shroud, wherein said leading edge and said trailing edge define an opening between adjacent wall portions, the opening providing access to the mechanical fastener and wherein said leading edge is rounded to thereby urge cooling fluid within said upstream seal cavity to flow circumferentially and to block an axial flow of fluid between said leading edge and said trailing edge.

6. The stator vane assembly according to claim 1, wherein each wall portion has a wall thickness, and wherein the finite distance $\alpha$ is less than or equal to the wall thickness.

7. A turbine section for a gas turbine engine disposed about a longitudinal axis and having an axially extending flowpath, said gas turbine engine having an operational condition said turbine section including:

a first turbine rotor assembly, said first turbine rotor assembly being rotatable about the longitudinal axis and having a plurality of blades radially extending through said flowpath;

a second turbine rotor assembly disposed axially downstream of said first turbine rotor assembly, said second turbine rotor assembly being rotatable about the longitudinal axis and having a plurality of blades radially extending through said flowpath;

a seal runner axially extending between said first turbine rotor assembly and said second turbine rotor assembly, said seal runner being rotatable about said longitudinal axis and having a plurality of radially outwardly and circumferentially extending knife-edge seals; and a stator vane assembly disposed axially between said first turbine rotor assembly and said second turbine rotor assembly and radially outward of said seal runner, wherein said stator vane assembly, said first turbine rotor assembly, and said seal runner define an annular upstream seal cavity having effectively continuous flow surfaces, said upstream seal cavity bounding a circumferentially flowing annular body of fluid in the operational condition, wherein said stator vane assembly, said second turbine rotor assembly, and said seal runner define an annular downstream cavity, and wherein said stator vane assembly comprises:

a plurality of hollow vanes, wherein cooling fluid flows through each of said vanes in the operational condition;

a plurality of vane platforms, each vane platform disposed at the radially inner end of said vane and providing a flow surface for the flowpath;

a plurality of ejectors, each ejector disposed radially inward of a vane, each ejector being in communication with said hollow vane, each ejector having a duct directing the cooling fluid with a velocity, the magnitude of the velocity being greater than one-tenth (1/10) of the magnitude of the velocity of the circumferentially flowing annular body of fluid within said upstream seal cavity in the operational condition, the direction of the velocity being substantially tangential to the circumferentially flowing annular body of fluid within the upstream seal cavity in the operational condition, wall means providing a flow surface for the seal cavity which is effectively continuous in the circumferential direction, said wall means having a plurality of apertures permitting passage of cooling fluid from said plurality of ejectors to said upstream seal cavity wherein said wall means is comprised of a plurality of wall portions, each of said wall portions disposed on an ejector and having a leading edge and a trailing edge, said leading edge and said trailing edge disposed on circumferentially opposite ends of said wall portion, and wherein said trailing edge has a flow surface disposed a finite distance Δ axially upstream, relative to the direction of flow within the flow path, of a corresponding flow surface of a leading edge of a circumferentially adjacent wall portion, and wherein said leading edge is rounded to urge cooling fluid within the upstream seal cavity to flow circumferentially and to block an axial flow of fluid between said leading edge and said trailing edge; and a sealing shroud mounted radially inward of said plurality of vanes and said plurality of ejectors, said sealing shroud having an abradable surface engaging said plurality of knife-edge seals to block communication between the seal cavity and the downstream cavity; and wherein said sealing shroud, said plurality of vane platforms, and said plurality of ejectors define a pedestal volume, the gases within the pedestal volume being effectively static.

8. The turbine section according to claim 7, further including a mechanical fastener engaged with the sealing shroud, and wherein said leading edge and said trailing edge define an opening between adjacent wall portion, the opening providing access to the mechanical fastener.

9. The turbine section according to claim 7, wherein each wall portion has a wall thickness, and wherein the finite distance Δ is less than or equal to the wall thickness.

10. The turbine section according to claim 7, wherein the internal duct includes a straight portion having a length l, the straight portion directing the cooling fluid to flow in the tangential direction, wherein the aperture has an effective diameter $d_h$, and wherein the length l is greater than the effective diameter $d_h$ of the aperture.

11. An improved stator vane assembly for a gas turbine engine of the type disposed about a longitudinal axis, having an axially extending flowpath circumferentially disposed about the axis, a turbine section including a first rotor assembly disposed circumferentially about the axis, a second rotor assembly disposed circumferentially about the axis and axially downstream of the first rotor assembly, a seal runner disposed circumferentially about the axis and extending axially between the first rotor assembly and the second rotor assembly, the seal runner including sealing means, and wherein the first rotor assembly, second rotor assembly, and seal runner are rotatable about the axis in an operational condition, and wherein the improvement is comprised of:

the stator vane assembly being disposed axially between the first rotor assembly and the second rotor assembly and radially outward of the seal runner, wherein an annular upstream seal cavity is defined in part by said stator vane assembly, said upstream seal cavity having effectively continuous flow surfaces in the circumferential direction, wherein a downstream seal cavity is defined in part by said stator vane assembly, and wherein said stator vane assembly includes a plurality of vanes, each of the vanes being hollow to permit cooling fluid to pass through said vane, a sealing shroud mounted radially inward of said vanes, said sealing shroud engaging said seal runner to block gaseous communication between the upstream seal cavity and the downstream cavity, and a plurality of ejectors, each of said ejectors disposed radially inward of and being in communication with one of said plurality of hollow vanes, each ejector including an aperture permitting cooling fluid to flow into the seal cavity, and the plurality of ejectors defining wall means providing an effectively continuous, circumferential flow surface for the upstream seal cavity and to isolate said ejectors from said seal cavity, wherein said ejector includes an internal duct directing the cooling fluid with a velocity, the magnitude of the velocity imparted to the cooling fluid being greater than one-tenth (1/10) of the magnitude of the velocity of the circumferentially flowing annular body of fluid within the upstream seal cavity in the operational condition, and the direction of the velocity imparted being substantially tangential to the direction of the circumferentially flowing annular body of fluid within the upstream seal cavity in the operational condition, and wherein the internal duct includes a straight portion having a length l, the straight portion directing the cooling fluid to flow in the tangential direction, wherein the aperture has an effective diameter $d_h$, and wherein the length l is greater than the effective diameter $d_h$ of the aperture.

12. The stator vane assembly according to claim 11, wherein the wall portion includes a leading edge and a trailing edge, the leading edge and the trailing edge disposed on circumferentially opposite ends of the wall portion, and wherein the leading edge is rounded to thereby urge cooling fluid within the upstream sealing cavity to flow circumferentially and to block an axial flow of fluid between the leading edge and the trailing edge.

13. The stator vane assembly according to claim 11, wherein the wall portion includes a leading edge and a trailing edge, the leading edge and the trailing edge disposed on circumferentially opposite ends of the wall portion, and further including a mechanical fastener engaged with the sealing shroud, wherein the leading edge and the trailing edge define an opening between adjacent wall portions, the opening providing access to the mechanical fastener and wherein the leading edge is rounded to thereby urge cooling fluid within the upstream seal cavity to flow circumferentially and to block an axial flow of fluid between the leading edge and the trailing edge.

14. The stator vane assembly according to claim 11, wherein each wall portion has a wall thickness, and wherein the finite distance Δ is less than or equal to the wall thickness.

15. A stator vane for a gas turbine engine, the gas turbine engine being disposed about a longitudinal axis and having an axially extending flowpath circumferentially disposed about the axis, a turbine section including a first rotor assembly disposed circumferentially about the axis, a second rotor assembly disposed circumferentially about the axis and axially downstream of the first rotor assembly, a stator vane assembly disposed circumferentially about the axis and axially between the first and second rotor assemblies, a seal runner disposed circumferentially about the axis and radially inward of the stator vane assembly and extending axially between the first rotor assembly and the second rotor assembly, the seal runner including sealing means, the stator vane assembly including the stator vane and a plurality of adjacent stator vanes to rotate about the axis in an operational condition, wherein an annular upstream seal cavity is defined in part by the stator vane, the upstream seal cavity having effectively continuous flow surfaces in the circumferential direction, wherein a downstream seal cavity is defined in part by the stator vane, and wherein the stator vane includes;

a hollow airfoil permitting cooling fluid to pass through the vane;

a sealing shroud mounted radially inward of the vane, the sealing shroud engaging the seal runner to block gaseous communication between the upstream seal cavity and the downstream cavity; and an ejector, the ejector disposed radially inward of and being in communication with the hollow airfoil, the ejector including an aperture permitting cooling fluid to flow into the seal cavity, and the ejector defining a wall portion which, in conjunction with adjacent wall portions of adjacent stator vanes, defines wall means which provides an effectively continuous, circumferential flow surface for the upstream seal cavity and isolates the ejector from the seal cavity, the wall portion having a leading edge and a trailing edge, the leading edge and the trailing edge disposed on circumferentially opposite ends of the wall portion, and wherein in an installed condition the trailing edge has a flow surface disposed a finite distance Δ axially upstream, relative to the direction of flow within the flow path, of a corresponding flow surface of a leading edge of a circumferentially adjacent wall portion.

16. The stator vane according to claim 15, wherein the ejector includes an internal duct directing the cooling fluid with a velocity, the magnitude of the velocity imparted to the cooling fluid being greater than one-tenth (1/10) of the magnitude of the velocity of the circumferentially flowing annular body of fluid within the upstream seal cavity in the operational condition, and the direction of the velocity imparted being substantially tangential to the direction of the circumferentially flowing annular body of fluid within the upstream seal cavity in the operational condition.

17. The stator vane according to claim 16, wherein the internal duct includes a straight portion having a length l, the straight portion directing the cooling fluid to flow in the tangential direction, wherein the aperture has an effective diameter $d_h$, and wherein the length l is greater than the effective diameter $d_h$ of the aperture.

18. The stator vane according to claim 15, wherein the leading edge is rounded to thereby urge cooling fluid within the upstream sealing cavity to flow circumferentially and to block an axial flow of fluid between the leading edge and the trailing edge.

19. The stator vane according to claim 15, further including a mechanical fastener engaged with the sealing shroud, wherein the leading edge and the trailing edge define an opening between adjacent wall portions, the opening providing access to the mechanical fastener and wherein the leading edge is rounded to thereby urge cooling fluid within the upstream seal cavity to flow circumferentially and to block an axial flow of fluid between the leading edge and the trailing edge.

20. The stator vane according to claim 15, wherein each wall portion has a wall thickness, and wherein the finite distance Δ is less than or equal to the wall thickness.

21. A stator vane for a gas turbine engine, the gas turbine engine being disposed about a longitudinal axis and having an axially extending flowpath circumferentially disposes about the axis, a turbine section including a first rotor assembly disposed circumferentially about the axis, a second rotor assembly disposed circumferentially about the axis and axially downstream of the first rotor assembly, a stator vane assembly disposed circumferentially about the axis and axially between the first and second rotor assemblies, a seal runner disposed circumferentially about the axis and radially inward of the stator vane assembly and extending axially between the first rotor assembly and the second rotor assembly, the seal runner including sealing means, the stator vane assembly including the stator vane and a plurality of adjacent stator vanes to rotate about the axis in an operational condition, wherein an annular upstream seal cavity is defined in part by the stator vane, the upstream seal cavity having effectively continuous flow surfaces in the circumferential direction, wherein a downstream seal cavity is defined in part by the stator vane, and wherein the stator vane includes;

a hollow airfoil permitting cooling fluid to pass through the vane;

a sealing shroud mounted radially inward of the vane, the sealing shroud engaging the seal runner to block gaseous communication between the upstream seal cavity and the downstream cavity; and an ejector, the ejector disposed radially inward of and being in communication with the hollow airfoil, the ejector including an aperture permitting cooling fluid to flow into the seal cavity, and the ejector defining a wall portion which, in conjunction with adjacent wall portions of adjacent stator vanes, defines wall means which provides an effectively continuous, circumferential flow surface for the upstream seal cavity and isolates the ejector from the seal cavity, wherein the ejector includes an internal duct directing the cooling fluid with a velocity, the magnitude of the velocity imparted to the cooling fluid being greater than one-tenth (1/10) of the magnitude of the velocity of the circumferentially flowing annular body of fluid within the upstream seal cavity in the operational condition, and the direction of the velocity imparted being substantially tangential to the direction of the circumferentially flowing annular body of fluid within the upstream seal cavity in the operational condition, wherein the internal duct includes a straight portion having a length l, the straight portion directing the cooling fluid to flow in the tangential direction, wherein the aperture has an effective diameter $d_h$, and wherein the length l is greater than the effective diameter $d_h$ of the aperture.

22. The stator vane according to claim 21, wherein the wall portion includes a leading edge and a trailing edge, the leading edge and the trailing edge disposed on circumferentially opposite ends of the wall portion, and wherein the leading edge is rounded to thereby urge cooling fluid within the upstream sealing cavity to flow circumferentially and to block an axial flow of fluid between the leading edge and the trailing edge.

23. The stator vane according to claim 21, wherein the wall portion includes a leading edge and a trailing edge, the leading edge and the trailing edge disposed on circumferentially opposite ends of the wall portion, and further including a mechanical fastener engaged with the sealing shroud, wherein the leading edge and the trailing edge define an opening between adjacent wall portions, the opening providing access to the mechanical fastener and wherein the leading edge is rounded to thereby urge cooling fluid within the upstream seal cavity to flow circumferentially and to block an axial flow of fluid between the leading edge and the trailing edge.

24. The stator vane according to claim 21, wherein each wall portion has a wall thickness, and wherein the finite distance Δ is less than or equal to the wall thickness.

* * * * *